US011274434B2

(12) United States Patent
Hohmann, Jr.

(10) Patent No.: US 11,274,434 B2
(45) Date of Patent: Mar. 15, 2022

(54) WALL ANCHOR SYSTEM AND WASHER FOR CONNECTING TO A VENEER TIE

(71) Applicant: Ronald Hohmann, Jr., Parkland, FL (US)

(72) Inventor: Ronald Hohmann, Jr., Parkland, FL (US)

( * ) Notice: Subject to any disclaimer, the term of this patent is extended or adjusted under 35 U.S.C. 154(b) by 72 days.

(21) Appl. No.: 16/867,584

(22) Filed: May 6, 2020

(65) Prior Publication Data

US 2021/0348381 A1 Nov. 11, 2021

(51) Int. Cl.
*E04B 1/41* (2006.01)
*E04B 2/02* (2006.01)

(52) U.S. Cl.
CPC ..... *E04B 1/4185* (2013.01); *E04B 2/02* (2013.01); *E04B 2002/025* (2013.01)

(58) Field of Classification Search
CPC . E04B 1/40; E04B 1/41; E04B 1/4178; E04B 1/4185; E04B 2001/4192; E04B 2002/025
USPC ..... 52/712–715
See application file for complete search history.

(56) References Cited

U.S. PATENT DOCUMENTS 5,035,099 A * 7/1991 Lapish ..... E04F 13/0808 52/713
6,973,756 B2 12/2005 Hatzinikolas
7,415,803 B2 8/2008 Bronner
D702,544 S 4/2014 Hohmann, Jr.
8,726,597 B2 5/2014 Hohmann, Jr.
8,863,469 B2 10/2014 Curtis et al.
8,893,452 B2 11/2014 Hatzinikolas
9,140,001 B1 9/2015 Hohmann, Jr.
9,273,461 B1 3/2016 Hohmann, Jr.
9,803,355 B1 10/2017 Ripley et al.
9,945,414 B1 4/2018 Rodenhouse et al.
10,202,754 B2 2/2019 Hohmann, Jr.
D848,250 S 5/2019 Ripley et al.
2005/0279043 A1* 12/2005 Bronner ..... F16B 37/16 52/561
2013/0008121 A1* 1/2013 Dalen ..... E04G 21/00 52/704
2013/0232909 A1* 9/2013 Curtis ..... E04B 2/30 52/704
2014/0055236 A1* 2/2014 Kuebler ..... B60R 25/24 340/5.61
2014/0215958 A1* 8/2014 Duyvejonck ..... E04B 1/4178 52/713

(Continued)

FOREIGN PATENT DOCUMENTS

CA 2808917 A1 * 9/2013 ..... E04B 1/4178

*Primary Examiner* — William V Gilbert
(74) *Attorney, Agent, or Firm* — The Plus IP Firm; Derek Fahey, Esq.

(57) ABSTRACT

A system and method for a wall anchor including a washer for use in a cavity wall to connect to a veneer tie that joins an inner wythe and an outer wythe of the cavity wall are disclosed. The washer includes an opening configured to receive a shaft associated with the wall anchor, a washer body first side configured to abut one or more surfaces associated with the inner wythe, a washer body second side, and a washer body side wall. The washer body having at least one receiving element, including at least one receiving element opening configured to receive a portion of the veneer tie.

17 Claims, 8 Drawing Sheets

(56) References Cited

U.S. PATENT DOCUMENTS

| | | | | |
|---|---|---|---|---|
| 2015/0121792 | A1 | 5/2015 | Spoo et al. | |
| 2016/0252129 | A1* | 9/2016 | Rodenhouse | B25C 7/00 411/533 |

* cited by examiner

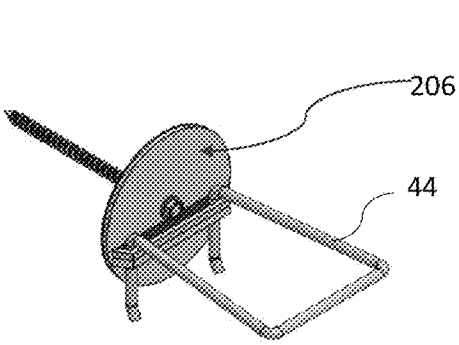
FIG. 2
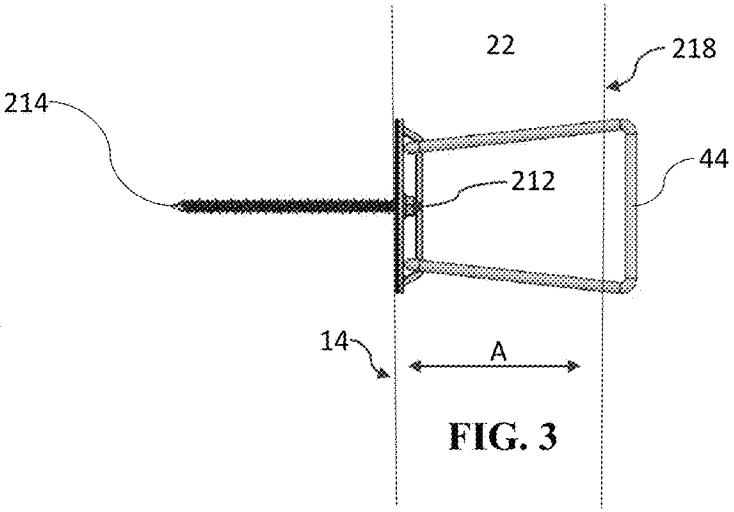
FIG. 3
FIG. 4
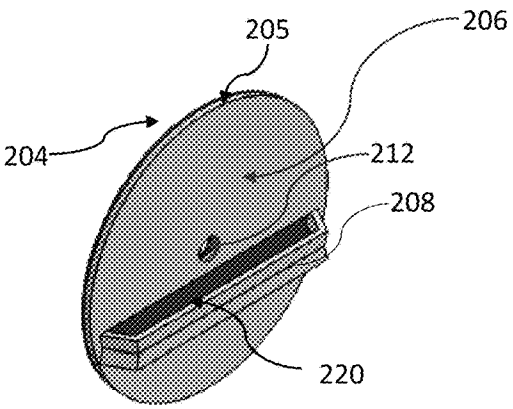
FIG. 6
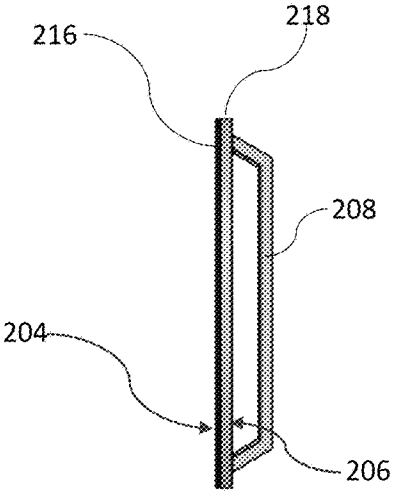
FIG. 7
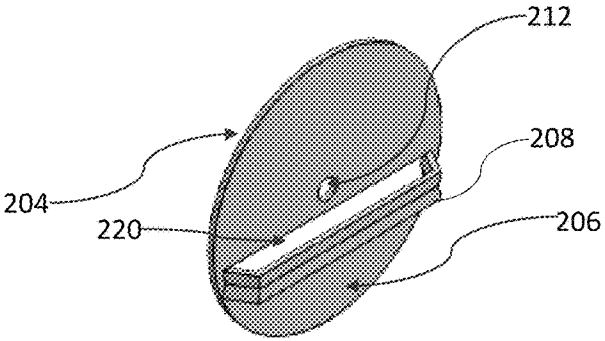
FIG. 5

WALL ANCHOR SYSTEM AND WASHER FOR CONNECTING TO A VENEER TIE

CROSS-REFERENCE TO RELATED APPLICATIONS

Not applicable.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not applicable.

TECHNICAL FIELD

The present invention relates to the field of anchoring systems for cavity walls, and more specifically, to the field of anchoring system washers for connecting to a veneer tie.

BACKGROUND

Minimizing the use of natural resources are vital components of the global strategy to protect the environment and mitigate climate change. The building construction sector represents a large portion of resource consumption. Much of today's anchoring systems require a backup wall to support horizontal transverse loads exerted by a veneer wall. The backup wall typically consists of stud wall, masonry wall, concrete wall, steel elements, etc. Anchoring systems for cavity walls are used to secure veneer walls of a building to overcome seismic and other forces, i.e., wind shear, etc.

A veneer wall is commonly defined as a wall having a facing of masonry units (brick veneer, stone veneer, etc.), or other weather-resisting, non-combustible materials, securely attached to the backup wall, but not so bonded as to exert common action under load intentionally. The veneer wall is supported horizontally by the backup wall via veneer ties embedded in joints on one end and attached to a backup wall anchor on the other end. Typically, the veneer ties the inner wythe and the outer wythe together and is flexible for in-plane horizontal and vertical movement and rigid perpendicular to the wall face. As a result, the veneer wall and the backup wall are isolated and do not behave identically under load. While the displacements perpendicular to the wall are typically the same, the vertical flexibility provided by the veneer tie allows for differences in response to vertical loading.

Current building construction methods require a wall anchor that connects a veneer tie that joins an inner wythe and an outer wythe of the cavity wall—subsequently requiring wall anchors to involve numerous parts. Among one of the numerous essential wall anchor parts, includes a washer. A washer is commonly configured to seal the opening into the inner wythe. Other embodiments of washers may include fastening an anchor bracket to a steel stud. As a result of the number of the wall anchors parts required, maintaining and, or stocking an adequate level of the different parts creates a lot of problems. Therefore, a need exists to improve over the prior art and, more particularly, for an improved washer that allows for the interconnection with veneer ties for use in conjunction with cavity walls having an inner wythe and an outer wythe.

SUMMARY

A wall anchor system and washer for use in a cavity wall is connected to a veneer tie that joins an inner wythe, and an outer wythe of the cavity wall is disclosed. This Summary is provided to introduce a selection of disclosed concepts in a simplified form that are further described below in the Detailed Description, including the drawings provided. This Summary is not intended to identify key features or essential features of the claimed subject matter. Nor is this Summary intended to be used to limit the claimed subject matter's scope.

In one embodiment, a washer for use in a cavity wall to connect to a veneer tie that joins an inner wythe and an outer wythe of the cavity wall is disclosed. The washer includes a hole on the washer body having a threaded hole wall. The washer body having a threaded hole wall consists of a washer body first side, a washer body second side, and a washer body side wall. The washer body having a threaded hole wall includes at least one receiving element configured to receive a portion of the veneer tie protruding from either the first side or the second side.

Additional aspects of the disclosed embodiment will be set forth in part in the Detailed Description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following Detailed Description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, serve to explain the principles of the disclosed embodiments. The embodiments illustrated herein are presently preferred, it being understood, however, that the invention is not limited to the precise arrangements and instrumentalities shown, wherein:

FIG. 2 is a side view of a washer body, according to a first exemplary embodiment of the present invention;

FIG. 3 is a side view of the washer body in contact with a veneer tie, according to the first exemplary embodiment of the present invention;

FIG. 4 is a perspective view of the washer body in contact with the veneer tie, according to the first exemplary embodiment of the present invention;

FIG. 5 is a perspective view of the washer body including an unthreaded opening, according to a second exemplary embodiment of the present invention;

FIG. 6 is a perspective view of a washer body including a threaded opening, according to a third exemplary embodiment of the present invention;

FIG. 7 is a side view of a washer body, according to the third exemplary embodiment of the present invention;

Like reference numerals refer to like parts throughout the several views of the drawings.

DETAILED DESCRIPTION

Figure 1:
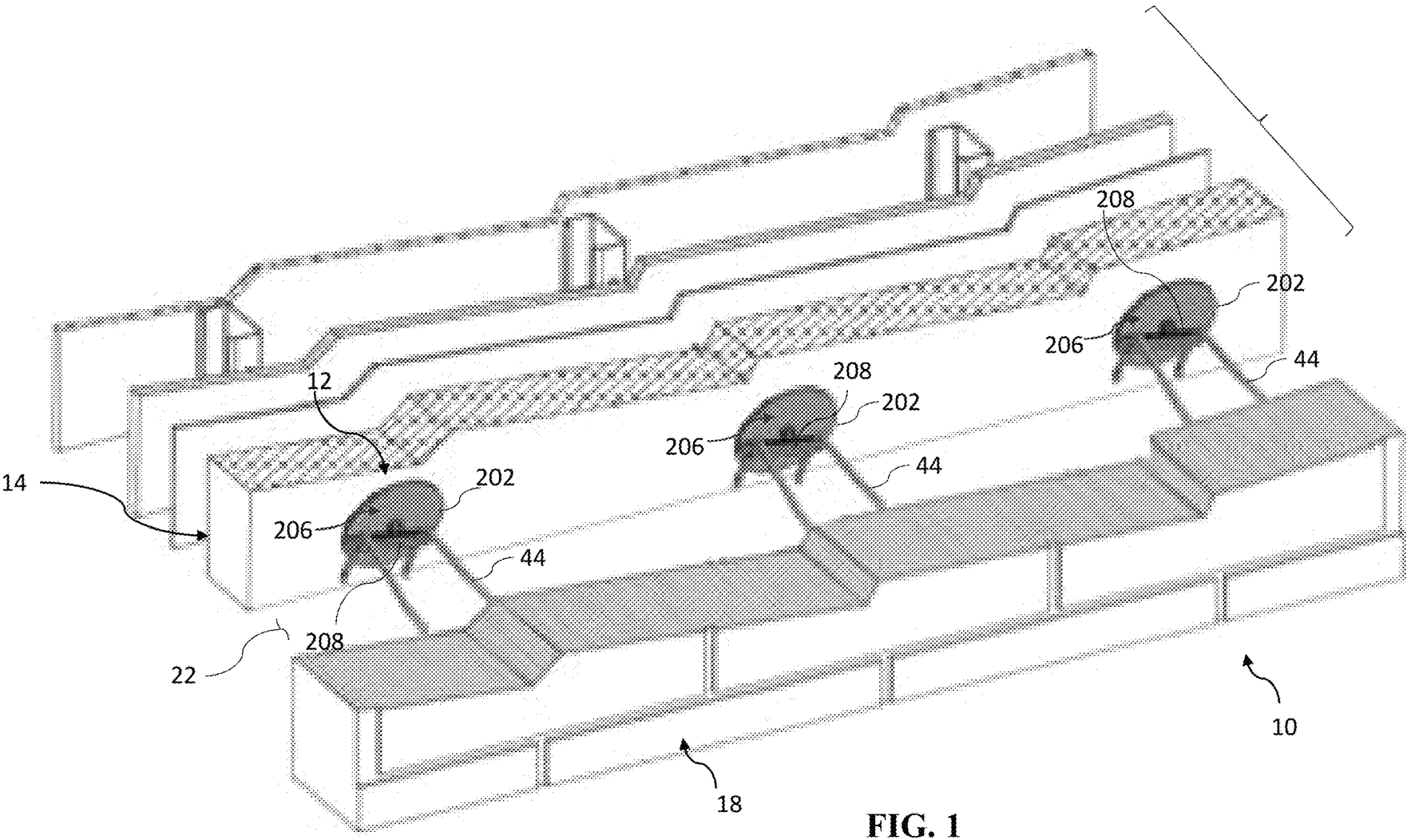
FIG. 1 is a front view of a wall anchor for use in a cavity wall, according to a first exemplary embodiment of the present invention.
Figure 10:
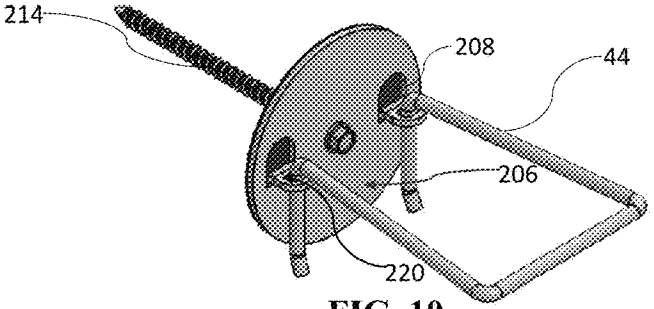
FIG. 10 is a perspective view of the washer body in contact with the veneer tie, according to the fourth exemplary embodiment of the present invention.
Figure 13:
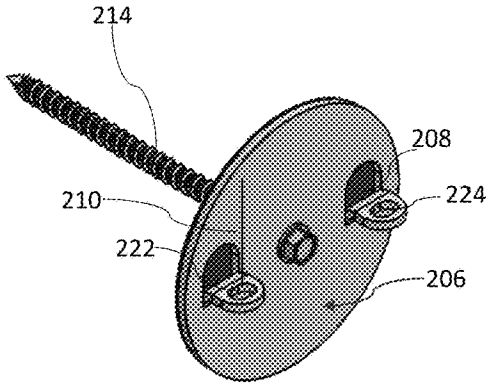
FIG. 13 is a second side view of the washer body, according to the fourth exemplary embodiment of the present invention.
Figure 9:
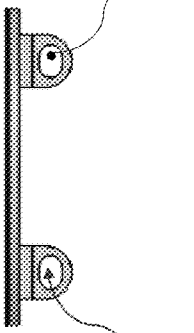
FIG. 9 is a first top view of the washer body, according to the fourth exemplary embodiment of the present invention.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions, or modifications may be made to the elements illustrated in the drawings, and the methods described herein may be modified by substituting reordering or adding additional stages or components to the disclosed methods and devices. Accordingly, the following detailed description does not limit the disclosed embodiments. Instead, the proper scope of the disclosed embodiments is defined by the appended claims.

The present invention improves upon the prior art by providing an enhanced wall anchor system and washer that includes a hole on its washer body and includes at least one receiving element configured to receive a portion of the veneer tie that joins an inner wythe and an outer wythe of the cavity wall. The present invention further improves upon the prior art by providing an enhanced washer with integral components thereby decreasing the number of parts required for a wall anchor. This would eliminate the assorted wall anchor construct utilizable with various wire formative veneer ties. As a result, the manufacturing costs and storage costs would be lowered, thus improving both logistics and efficiency.

Referring now to FIG. 1, an example cavity wall structure environment 10 configured for a wall anchor to be utilized in is presented according to an example embodiment of the present invention. Environment 10 comprises inner wythe or drywall backup 14 and outer wythe or facing wall 18, which cooperate to form cavity 22. The inner wythe may comprise a single membrane or multiple membranes. In one embodiment, wall anchor is configured to support contact with one or more veneer ties 44, wall ties, or any other wire or sheet metal devices used to connect two or more masonry wythes or used to connect masonry veneers to a structural backing system. It is to be understood that structures other than environment 10 may be suitable for wall anchor 12 to be utilized without departing from the scope of the invention. In one embodiment, wall anchor 12 may comprise a washer, referred to as a washer body 202 throughout the disclosure, configured to function as at least one component or as an integrateable component of wall anchor 12, and further configured to assist wall anchor 12 in utilizing a veneer tie 44 to join inner wythe 14 to outer wythe 18 for horizontal load transfer.

In one embodiment, the example cavity wall structure environment 10 is configured for a system for connecting one or more veneer ties 44 designed for joining inner wythe 14 and outer wythe 18. In one embodiment, the system comprises veneer tie 44 and wall anchor 12 further comprising an anchor shaft first end portion and an anchor shaft second end portion, wherein the anchor shaft first end portion is configured to be secured to inner wythe 14 and the anchor shaft second end portion is configured to be threadedly attached with an opening associated with the washer, which is described in greater detail below. In one embodiment, wall anchor 12 may position the washer in a manner that abuts against the outer most surface of inner wythe 14 or one or more membranes of inner wythe 14. In other embodiments, the washer be attached to the inner wythe by using other methods. For example, the washer may be attached to the inner wythe without requiring a threaded hole. For example, the washer body may be attached to the inner wythe using a bolt or other item configured to pass through a non-threaded hole that attaches the washer to the inner wythe.

Referring to FIGS. 2-25, wall anchor 12 comprises a washer body 202 comprising a washer body first side 204, a washer body side wall 205, a washer body second side 206, at least one receiving element 208, at least one axis 210, and at least one opening or aperture 212. It is to be understood that wall anchor 12 may comprise multiple of any component disclosed herewith as long as wall anchor and washer body 202 may utilize said additional components for the intended functionality. In one embodiment, receiving element 208 is configured to protrude or extend from washer body first side 204 to washer body second side 206 wherein receiving element 208 is further configured to receive a portion of veneer tie 44. In other embodiments, the receiving element extends only from the second side 206. In one embodiment, receiving element 208 may receive the portion of veneer tie 44 via a receiving element opening 220, an aperture 212 is dimensioned to axially receive and mate with a shaft 214, which may be associated with wall anchor 12, supporting full integration between washer body 202 and the surface of inner wythe 14 strengthened by the impaling and tightening of the shaft 214 through opening 212. In one or more embodiments, washer body 202 supports an integral configuration, as depicted in FIG. 4, wherein receiving element 208 is integrated into a surface associated with washer body 202, allowing veneer tie 44 to be attached or affixed directly on a surface of washer body 202 via receiving element 208.

In other words, receiving element 208 is formed from a surface portion of at least washer body first side 204 or washer body second side 206, and the receiving element opening 220 is allocated to receiving element 208. As described herein, a surface portion of washer body 202 may be any panel configured to be punched out, carved out, outward protruding, or sculpted in order to generate receiving element opening 220 shaped and sized to fit at least a portion of a veneer tie 44. It should be appreciated that washer body 202 may have other shapes, dimensions, and orientations that allow washer body 202 to connect to veneer tie 44 and join inner wythe 14 and outer wythe 18, and receiving element 208 may be shaped, sized, and located in various arrangements that allow direct outward protrusion from washer body 202, such variations are within the spirit and scope of the claimed invention. In one embodiment, receiving element 208 and/or receiving element opening 220 may comprise neoprene or any other applicable material disposed along with the interior in order to combat degradation commonly sustained by wall anchor systems and their components. In one embodiment, washer body sides 204 and 206 are configured to comprise a plurality of dimples, grooves, embossing, or any other applicable features known to those of ordinary skill in the art that still allows washer body 202 to serve its intended functionality.

In one embodiment, opening 212 may comprise a threaded wall section configured to interact with shaft 214, which may be a threaded shaft configured to interlace or interlock with the threaded wall section in order to provide efficient retention of washer body 202 to inner wythe 14. In other embodiments, opening 212 may not comprise a threaded wall section. In one embodiment, the interactive configuration between opening 212 and shaft 214 may be accomplished by a screw, bolt, nail, rivet, or any other applicable mechanism for affixing and retaining washer body 202 to an applicable structure. In application, shaft 214 bores or penetrates through opening 212 resulting in washer body 202 being retained and subsequently washer body 202 abuts at least a surface of inner wythe 14 allowing veneer tie 44 to be attached, interlaced, or any other applicable means of affixing to receiving element 208, as depicted in FIGS. 3 & 4. In one embodiment, axis 210 serves as a centrally located axis, as illustrated in FIG. 2, configured to support loosening and tightening respective to inner wythe 14 and/or shaft 214. It is to be understood that axis 210 may be applicable to each receiving element 208 or receiving element opening 220 depending upon the configuration of wall anchor 12.

In one embodiment, receiving element 208 is defined by an elongated u-shaped body, as illustrated by FIGS. 1-7, in which at least washer body first side 204 and/or washer body second side 206 define receiving element opening 220 as a protruding surface integral to washer body 202. The elongated u-shaped may be formed based off the protruding surface or a plurality of protrusions from washer body first side 204, washer body side wall 205, and/or washer body second side 206; as long as the receiving element opening 220 is shaped and sized to support direct contact with a portion of veneer tie 44. It should be appreciated that receiving element 208 can have other shapes, dimensions, and orientations that allow washer body 202 to connect to a portion of veneer tie 44, such variations are within the spirit and scope of the claimed invention. For example, receiving element 208 may be a plurality of receiving elements 208 manifested as extending or outward protruding tabs, flanges, or any other applicable mechanism comprising openings configured to be attached to which are disposed along one or more surfaces of washer body 202 wherein each receiving element 208 comprises its own receiving element opening 220 and is associated with one or more axes 210 supporting loosening and tightening of washer body 202 to a surface of inner wythe 14 while remaining integral components of washer body 202, as illustrated in FIGS. 8-25. In another example, FIGS. 10, 15, 21, and 25 illustrate various embodiments of washer body 202 comprising a plurality of receiving elements 208 each of which comprises at least one receiving element opening 220 configured for a portion of veneer tie 44 to be hooked, attached, clamped, clasped, or any other applicable form of affixing to without damaging or compromising veneer tie 44. The various integrated configurations of washer body 202 allow for the reduction of upkeep of multiple cumbersome components associated with the prior art that are required in order to affix a washer to an inner wythe.

In one embodiment, washer body first side 204 comprises a sealing material 216 and washer body second side 206 comprises a structural element 218, as illustrated in FIGS. 6 & 7. In one embodiment, each of both washer body first side 204 and washer body second side 206 comprises sealing material 216 connected with structural element 218. In one embodiment, washer body 202 is configured to be moved angularly horizontally (represented by line A) via an applied force inherent to interactions with washer body 202, as depicted in FIG. 3, in which structural element 218 is configured to resist movement caused by the applied force. Sealing material 216 is configured to seal washer body 202 against the inner wythe 14, generating a barrier-like structure configured to seal the connection between shaft 214 and opening 212 when shaft 214 is impaled through opening 212. Sealing material 216 may be composed of neoprene, EPDM, foam, Ariaprene®, rubber, or any other applicable material configured to be comprised in a washer. Some other compressible materials for seal material may include polyurethane, silicone, polyether, plastic, thermoplastic, open-cell foam, closed-cell foam, and acrylic.

Structural element 218 may be composed of a metallic material, a non-metallic material, or any combination thereof. In application, sealing material 216 is configured to be connected or affixed to structural element 218 wherein sealing material 216 abuts an outward facing surface or one or more membranes of inner wythe 14. Types of non-metallic material for structural element made from a high temperature material comprising at least one of an ablative material, a boron fiber material, a carbon fiber material, a ceramic matrix composite material, a composite material, an epoxy matrix composite, a fatigue composite material, a fiber composite, a fiber-matrix interface, a filament material, a filament wound structures composite material, a filament-matrix material, a flammability composite materials, a glass fiber reinforced plastic material, a honeycomb material, an insulation composite material, a laminate material, a metal filament system, a metal matrix composite (MMC), a nano-composite, an off-gassing/out-gassing composite material, a polymer matrix composite, a reinforcing fibers composite material, a stacking sequence composite material, a surface property composite material, whisker composite, a woven composite material, or any combination of the foregoing materials.

Figure 12:
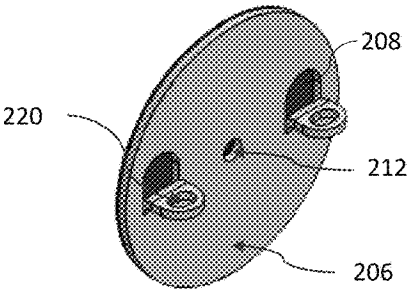
FIG. 12 is a first side view of the washer body, according to the fourth exemplary embodiment of the present invention.
Figure 8:
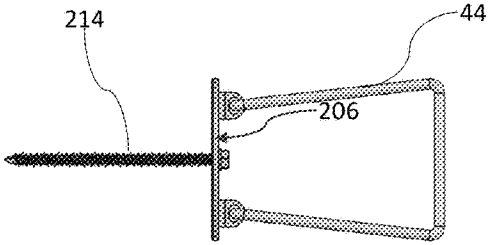
FIG. 8 is a bottom view of the washer body in contact with the veneer tie, according to a fourth exemplary embodiment of the present invention.
Figure 11:
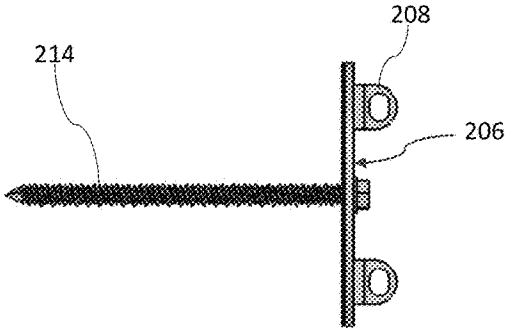
FIG. 11 is a second top view of the washer body, according to the fourth exemplary embodiment of the present invention.
Figure 15:
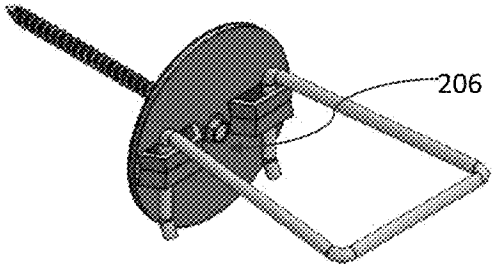
FIG. 15 is a perspective view of the washer body in contact with the veneer tie, according to the fifth exemplary embodiment of the present invention.
Figure 17:
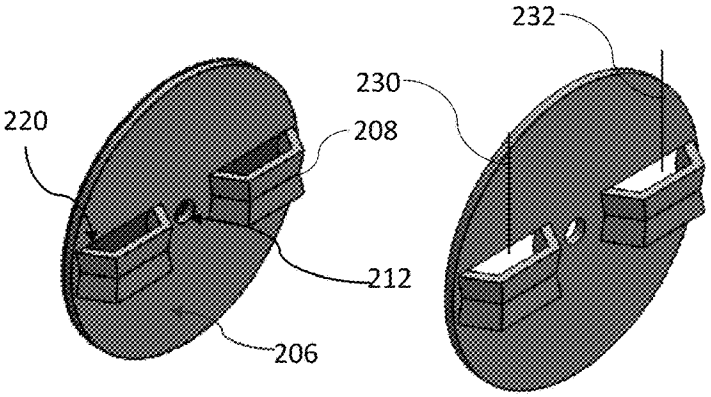
FIG. 17 is a perspective view of the washer body, according to the fifth exemplary embodiment of the present invention.
Figure 14:
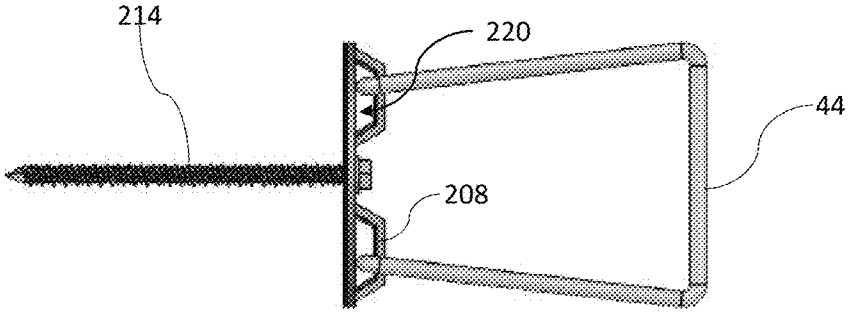
FIG. 14 is a first top view of the washer body in contact with the veneer tie, according to a fifth exemplary embodiment of the present invention.
Figure 16:
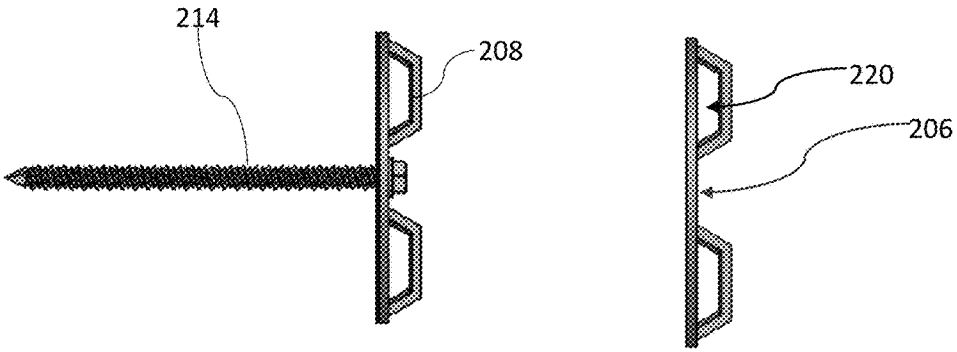
FIG. 16 is a second top view of the washer body, according to the fifth exemplary embodiment of the present invention.

In one embodiment, washer body 202 comprises a plurality of receiving elements 208, in particular two, wherein the plurality of receiving elements 208 are disposed of across a surface of washer body 202 in a manner in which each of the plurality of receiving elements 208 is equidistant from opening 212, as illustrated in FIGS. 12 & 17. This configuration allows a first portion and a second portion of veneer tie 44 to be attached respectively to each of the equidistant receiving elements 208 via receiving element openings 220.

Figure 19:
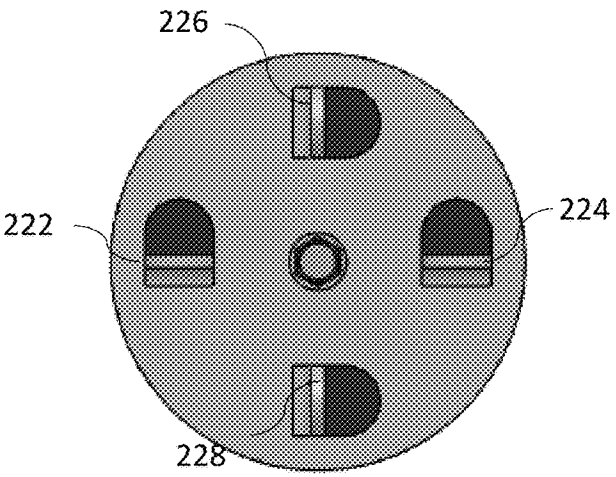
FIG. 19 is a top view of the washer body, according to the sixth exemplary embodiment of the present invention.
Figure 18:
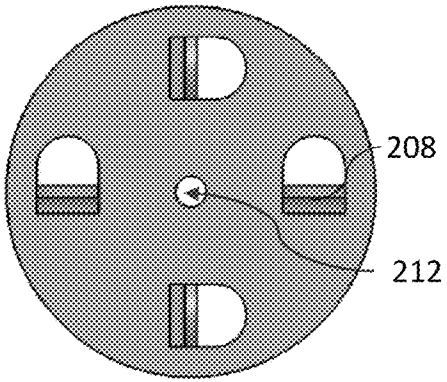
FIG. 18 is a first perspective view of the washer body, according to a sixth exemplary embodiment of the present invention.
Figure 18:
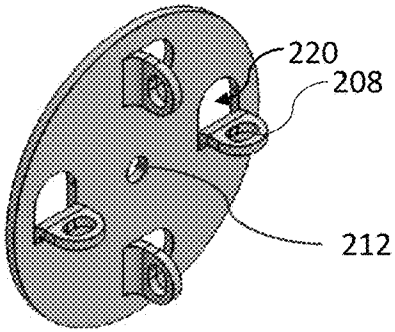
Figure 21:
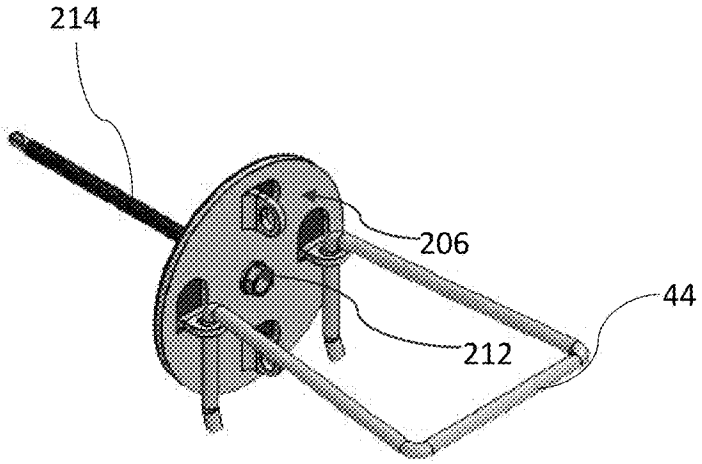
FIG. 21 is a third perspective view of the washer body in contact with the veneer tie, according to the sixth exemplary embodiment of the present invention.
Figure 20:
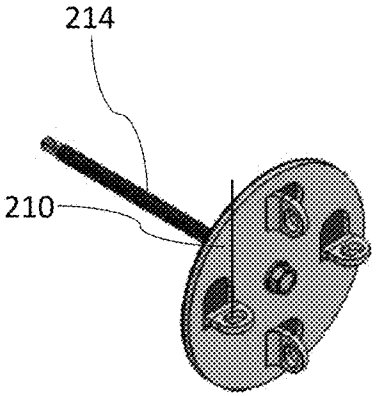
FIG. 20 is a second perspective view of the washer body, according to the sixth exemplary embodiment of the present invention.
Figure 23B:
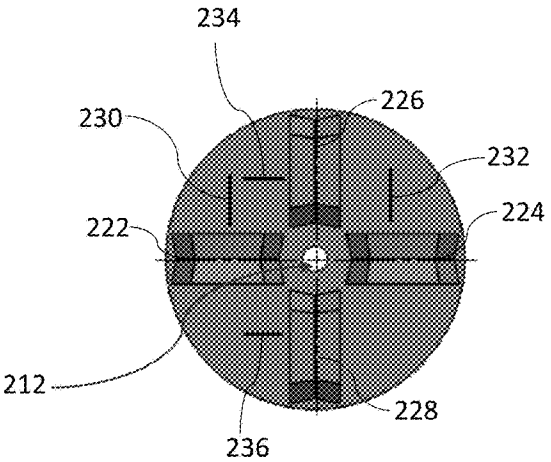
FIG. 23B is a front view of the washer, according to the seventh exemplary embodiment of the present invention.
Figure 23A:
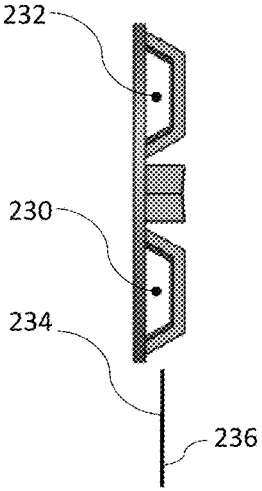
FIG. 23A is a top view of the washer, according to the seventh exemplary embodiment of the present invention.
Figure 25:
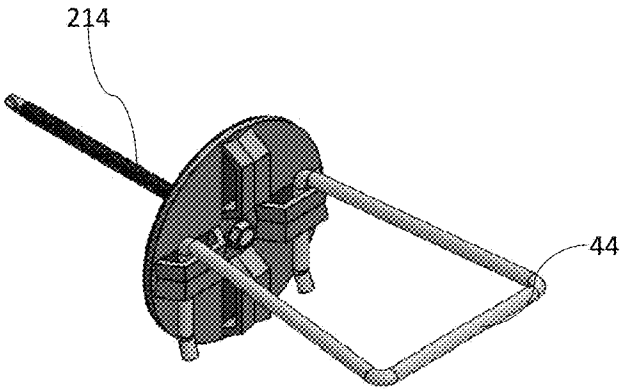
FIG. 25 is a third perspective view of the washer body in contact with a veneer tie, according to the seventh exemplary embodiment of the present invention; and, FIG. 26 is a block diagram depicting an exemplary method for anchoring a veneer wall to an inner wythe for horizontal load transfer, according to an exemplary embodiment of the present invention.
Figure 22:
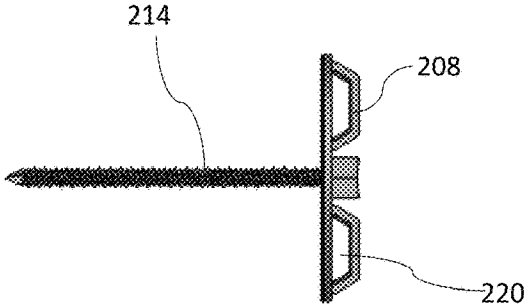
FIG. 22 is a first perspective view of a washer body, according to a seventh exemplary embodiment of the present invention.
Figure 22:
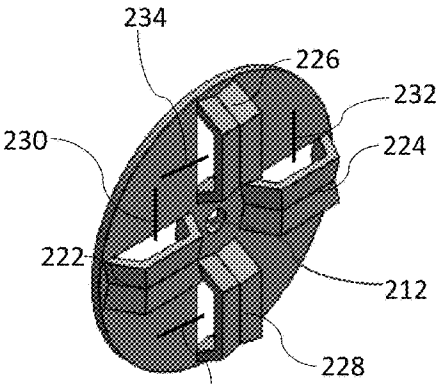
Figure 24:
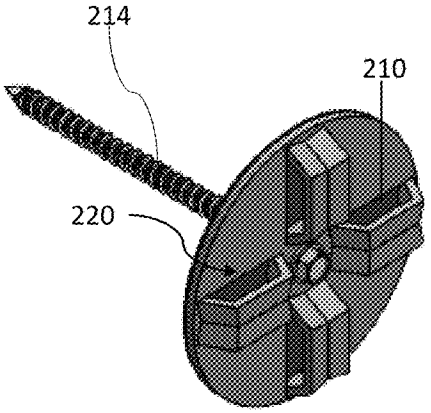
FIG. 24 is a second perspective view of the washer body, according to a seventh exemplary embodiment of the present invention.

In one embodiment, washer body 202 comprises four equidistant receiving elements 208 respective to opening 212, wherein a first receiving element 222 is positioned to the left of opening 212, a second receiving element 224 is positioned to the right of opening 212, a third receiving element 226 is positioned directly above opening 212, and a fourth receiving element 228 is positioned directly below opening 212, as illustrated in FIGS. 19 & 22. First receiving element 222 comprises a first longitudinal axis 230 in a first direction, second receiving element 224 comprises a second longitudinal axis 232 in the first direction, third receiving element 226 comprises a third longitudinal axis 234 in a second direction, and receiving element 228 comprises a fourth longitudinal axis 236 in the second direction wherein the first direction is perpendicular to the second direction. It is to be understood that each of receiving elements 222-228 comprises a receiving element opening 220 that may be manifested via an extended tab, loop, handle, grip, or any other applicable mechanism configured to come into direct contact and maintain retention of a portion of a veneer tie via an integral configuration with washer body 202. Each configuration comprising more than one receiving element is configured to be symmetrical in order to support greater angular movement in a plane with respect to the longitudinal axes. In one embodiment, each of receiving elements 222-228 and/or receiving element openings 220 may comprise neoprene or any other applicable material disposed along with the interior. This configuration allows for the first portion of veneer tie 44 to be affixed to receiving element opening 220 associated with first receiving element 222 or third receiving element 226, and the second portion of veneer tie 44 to be affixed to receiving element opening 220 associated with second receiving element 224 or third receiving element 228. Thus, the first and second portions of veneer tie 44 are respectively affixed to directly opposing receiving element openings 220 allowing the perpendicular longitudinal axes to serve as a reference for greater angular movement of washer body 202 in the plane configured to comprise at least first longitudinal axis 230 and second longitudinal axis 232 in the two equidistant receiving elements configuration and a first longitudinal axis 230, second longitudinal axis 232, third longitudinal axis 234, and fourth longitudinal axis 236 in the four equidistant receiving elements configuration.

Figure 26:
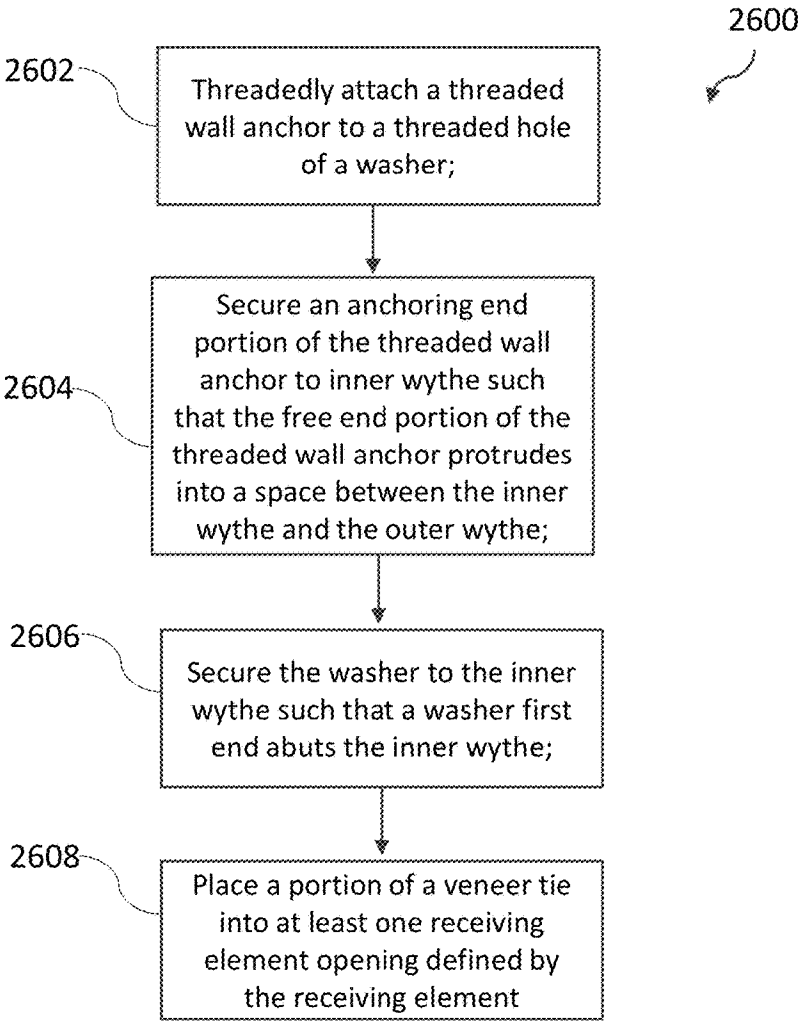

Referring now to FIG. 26, a method 2600 for anchoring a veneer wall to inner wythe 14 for horizontal load transfer is depicted. In step 2602, wall anchor 12 is threadedly attached to opening 212 of washer body 202, wherein wall anchor 12 may serve as a component of an anchoring system associated with shaft 214. As mentioned above, in other embodiments, the opening 212 may also not be threaded. In one embodiment, the anchor shaft first end portion associated with wall anchor 12 assists in securing wall anchor 12 to inner wythe 14. Shaft 214 interacts and integrates with one or more threaded wall sections of opening 212, allowing washer body 202 to be fully integrated with wall anchor 12. In step 2604, once wall anchor 12 has been threadedly attached to opening 212, the second end portion associated with wall anchor 12, also referred to as the free end portion of wall anchor 12, protrudes into cavity 22, which is a space formed between inner wythe 14 and outer wythe 18, and a portion of wall anchor 12 is secured to inner wythe 14, as depicted in FIG. 3. In one embodiment, the anchor shaft first end portion is secured to inner wythe 14 while the anchor shaft second end portion is threadedly attached or affixed to opening 212 allowing the full body of the anchor shaft to extend from inner wythe 14 to cavity 22 and/or outer wythe 18 depending on the configuration of wall anchor 12. As mentioned above, the washer body may also be configured to be attached using an opening 212 that is not threaded by using some other type of means. It is to be understood that veneer tie 44 may occupy space in both cavity 22 and outer wythe 18 subject to the configuration and length of veneer tie 44. In step 2606, washer body 202 is secured to inner wythe 14 in such a manner that washer body first side 204 abuts against the outer most surface of inner wythe 14 or one or more membranes of inner wythe 14. It is to be understood that at least one or more surfaces of washer body 202 are to be abutting with at least one surface associated with inner wythe 14 once wall anchor 12 has successfully been threadedly attached (or otherwise attached) to opening 212, and anchor shaft first end secures the abutting relationship between washer body 202 and inner wythe 14. In step 2608, a portion of veneer tie 44 is placed in at least one receiving element 208 via the portion of veneer tie 44 interacting with receiving element opening 220 defined by receiving element 208. It is to be understood that the amount of portions of veneer tie 44 interacting with the plurality of receiving element openings 220 is subject to the applicable configuration of wall anchor 12 and/or washer body 202. In other words, the more receiving elements 208 available based on the configuration of washer body 202, the more portions of veneer tie 44 may be hooked, interlaced or attached to washer body 202 via the receiving element openings 220.

Figure 27:
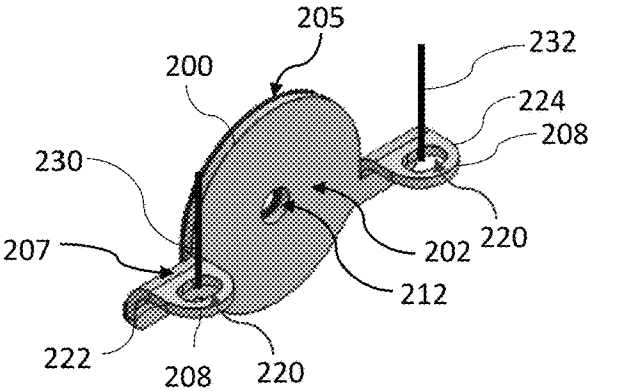
FIG. 27 is a first perspective view of a washer body, according to an eighth exemplary embodiment of the present invention.
Figure 28:
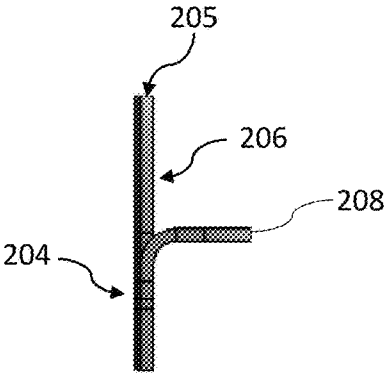
FIG. 28 is a top view of the washer, according to the eighth exemplary embodiment of the present invention.
Figure 29:
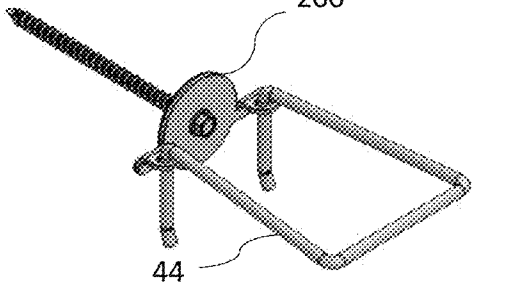
FIG. 29 is a front view of the washer, according to the eighth exemplary embodiment of the present invention.

In another embodiment, washer body 202 comprises of two equidistant receiving elements 208 that defines an extension element 207 that extends radially outward from the main perimeter 200 of the washer body as illustrated in FIGS. 27-29. In the present embodiment illustrated in FIGS. 27-29, the perimeter defines a circular shaped perimeter. However, other shapes may also be used and are within the spirit and scope of the present invention. First receiving element 222 comprises a first longitudinal axis 230 in a first direction and second receiving element 224 comprises a second longitudinal axis 232 in the first direction. It is to be understood that each of above-mentioned receiving elements 222, 224 comprises a receiving element opening 220 that may be manifested via an extended tab, loop, winged element, handle, grip, or any other applicable mechanism configured to come into direct contact and maintain retention of a portion of a veneer tie via an integral configuration with washer body 202. In other words, the receiving element structure is integral with the material of the side of the washer body. Other embodiments that extend out from the main perimeter 200 may also be used and are within the spirit and scope of the present invention. Each configuration that includes more than one receiving element may be symmetrical in order to support greater angular movement in a plane with respect to the longitudinal axes. In one example embodiment, each of receiving elements 222, 224 and/or receiving element openings 220 may comprise neoprene or any other applicable material disposed along with the interior. The opening 212 may be threaded so that it is configured to receive the threaded elongated shaft and attached directly to the inner wythe.

Figure 30:
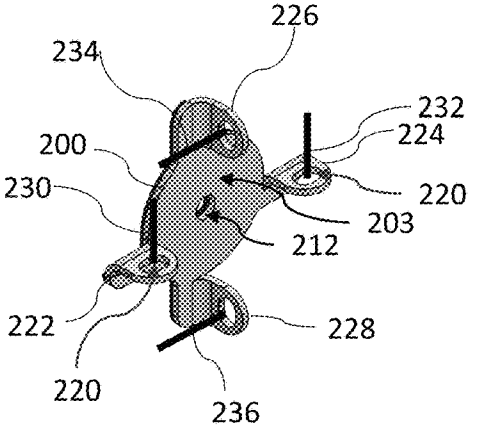
FIG. 30 is a second perspective view of the washer body, according to a ninth exemplary embodiment of the present invention.
Figure 31:
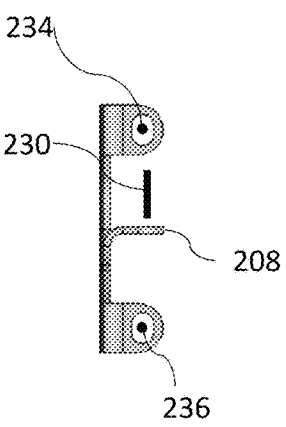
FIG. 31 is a third perspective view of the washer body in contact with a veneer tie, according to the ninth exemplary embodiment of the present invention.
Figure 32:
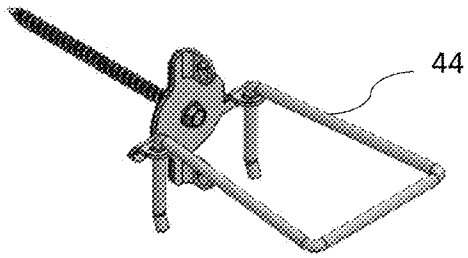
FIG. 32 is a third perspective view of the washer body in contact with a veneer tie, according to the ninth exemplary embodiment of the present invention.

In another embodiment, washer body 202 comprises of four equidistant receiving elements 208 that defines an extension element 207 that extends radially outward from the main perimeter 200 of the washer body as illustrated in FIGS. 30-32. First receiving element 222 comprises a first longitudinal axis 230 in a first direction, second receiving element 224 comprises a second longitudinal axis 232 in the first direction, third receiving element 226 comprises a third longitudinal axis 234 in a second direction, and receiving element 228 comprises a fourth longitudinal axis 236 in the second direction wherein the first direction is perpendicular to the second direction. It is to be understood that each of above-mentioned receiving elements 222, 224, 226, 228 comprises a receiving element opening 220 that may be manifested via an extended tab, loop, handle, grip, or any other applicable mechanism configured to come into direct contact and maintain retention of a portion of a veneer tie via an integral configuration with washer body 202. Each configuration comprising more than one receiving element is configured to be symmetrical in order to support greater angular movement in a plane with respect to the longitudinal axes. In one example embodiment, each of receiving elements 222, 224, 226, 228 and/or receiving element openings 220 may comprise neoprene or any other applicable material disposed along with the interior. As explained above, the receiving elements protrude outward from the side of the washer body and (as illustrated in FIG. 27-32 the receiving elements extend radially outward from the main perimeter 200 of the washer body.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

I claim:

1. A washer for use in a cavity wall to connect to a veneer tie that joins an inner wythe and an outer wythe of the cavity wall comprising:

a washer body having a perimeter, a washer body first side, a washer body second side and a washer body side wall;

a hole substantially centrally located and through the washer body; and, at least one receiving tab formed within the perimeter and protruding from at least one of the washer body first side and washer body second side, wherein the at least one receiving tab has an opening therethrough.

2. The washer of claim 1, where the least one receiving tab protrudes outward from at least one of the washer body first side and washer body second side of the washer body.

3. The washer of claim 2, where each washer body comprises a comprising sealing element connected with a structural element.

4. The washer of claim 3, where the sealing element comprises at least one of neoprene, EPDM, foam, rubber, and any combination thereof.

5. The washer of claim 1 where two receiving tabs are disposed on the washer body, where the first of the two receiving tabs is positioned on first side of a midpoint of the washer body, and the second of the two receiving tabs is positioned on a second side of the midpoint, where the second side opposes the first side.

6. The washer of claim 1 where the least one receiving tab is formed from a surface portion of at least one the washer body first side or washer body second side.

7. The washer of claim 1 where four receiving tabs are disposed on the washer body, where the first of the four receiving tabs is positioned on a first side of a midpoint of the washer body, where the second of the four receiving tabs is positioned on a second side of the midpoint, wherein the second side opposes the first side, where the third of the four receiving tabs is positioned on a third side of the midpoint, and, where the fourth of the four receiving tabs is positioned on a fourth side of the midpoint, wherein the fourth side opposes the third side.

8. The washer of claim 7 where the opening of the first of the four receiving tabs has a first main longitudinal axis arranged in a first direction;

the opening of the second of the four receiving tabs has a second main longitudinal axis arranged in the first direction;

the opening of the third of the four receiving tabs has a third main longitudinal axis arranged in a second direction perpendicular with the first direction; and, the opening of the fourth of the four receiving tabs has a fourth main longitudinal axis arranged in the second direction.

9. The washer of claim 1, where the least one receiving tab defines an extension body that extends radially outward from the perimeter of the washer body.

10. The washer of claim 1, where each respective receiving tab of the at least one receiving tab extends radially outward from the perimeter of the washer body.

11. A system for connecting a veneer tie that joins an inner wythe and an outer wythe comprising:

a veneer tie;

an anchor shaft having an anchor shaft first end portion and an anchor shaft second end portion, where the anchor shaft first end portion is secured to the inner wythe;

a washer having a perimeter, a washer body first side, a washer body second side and a threaded hole substantially centrally located and the washer body, where the second end portion of the anchor shaft is threadedly attached with the threaded hole;

where the washer body first side abuts the inner wythe; and, at least one receiving tab formed within the perimeter and protruding from the washer body second side, wherein each receiving tab has an opening therethrough receiving a portion of the veneer tie.

12. The system of claim 11, where the at least one receiving tab extends outward directly from the washer body.

13. The washer of claim 11, where each washer body comprises a comprising sealing element connected with a structural element, where the sealing element abuts an outward facing surface of the inner wythe.

14. The system of claim 11 where two receiving tabs are disposed on the washer body, where the first of the two receiving tabs is positioned on first side of a midpoint of the washer body, and the second of the two receiving tabs is positioned on a second side of the midpoint, where the second side opposes the first side.

15. The system of claim 11 where the least one receiving tab is formed from a surface portion of at least one the washer body first side or washer body second side.

16. A method of anchoring a veneer wall to an inner wythe for horizontal load transfer, the method comprising the steps of:

attaching a free end portion of a threaded wall anchor through a substantially centrally located hole of a washer, where the washer has perimeter, a washer first side, a washer second side and a receiving tab formed within the perimeter and extending from outward from at least one of the washer first side and the washer second side;

securing an anchoring end portion of a threaded wall anchor to an inner wythe such that the free end portion of the threaded wall anchor protrudes into a space between the inner wythe and the outer wythe;

further securing the washer to the inner wythe such that a washer first end abuts the inner wythe; and, placing a portion of a veneer tie into an opening on at least one receiving tab.

17. The method of claim 16, where the least one receiving tab extends outward directly from the washer.

* * * * *